US005288847A

United States Patent [19]

Harmalker et al.

[11] Patent Number: 5,288,847

[45] Date of Patent: Feb. 22, 1994

[54] FABRIC CONDITIONING COMPOSITION CONTAINING ALKANOL AMINE ESTER AND ACID

[75] Inventors: Subhash Harmalker, Somerset, N.J.; Jean-Paul Grandmaire, Andrimont, Belgium; Viviane Tack, Soumagne, Belgium; Alain Jacques, Blegny, Belgium

[73] Assignee: Colgate-Palmolive Company, New York, N.Y.

[21] Appl. No.: 934,097

[22] Filed: Aug. 21, 1992

[51] Int. Cl.[5] ..... D06M 13/325

[52] U.S. Cl. ..... 252/8.8; 252/8.6; 252/8.9

[58] Field of Search ..... 252/8.6–8.9

[56] References Cited

U.S. PATENT DOCUMENTS

| | | | |
|---|---|---|---|
| 3,915,867 | 10/1975 | Kang et al. | 252/8.8 |
| 3,954,630 | 5/1976 | Ramachandran | 252/8.6 |
| 4,045,358 | 8/1977 | Ramachandran | 252/8.6 |
| 4,370,272 | 1/1983 | Wechsler et al. | 260/404 |
| 4,426,299 | 1/1984 | Verbruggen | 252/8.8 |
| 4,514,444 | 4/1985 | Ives et al. | 427/242 |
| 4,828,722 | 5/1989 | Steltenkamp | 252/8.8 |
| 4,844,823 | 7/1989 | Jacques et al. | 252/8.8 |
| 4,869,836 | 9/1989 | Harmalker | 252/8.8 |
| 5,066,414 | 11/1991 | Chang | 252/8.8 |

FOREIGN PATENT DOCUMENTS

| | | |
|---|---|---|
| 443313 | 8/1991 | European Pat. Off. . |
| 0479608 | 4/1992 | European Pat. Off. . |
| 3312328 | 10/1984 | Fed. Rep. of Germany . |
| 3710064 | 10/1988 | Fed. Rep. of Germany . |
| 4111966 | 10/1992 | Fed. Rep. of Germany . |
| 050373 | 2/1992 | Japan . |
| 257372 | 9/1992 | Japan . |

*Primary Examiner*—Paul Lieberman
*Assistant Examiner*—Michael P. Tierney
*Attorney, Agent, or Firm*—Bernard Lieberman; Robert C. Sullivan

[57] ABSTRACT

Environmentally compatible and biodegradable fabric conditioning compositions are provided having improved softening properties while providing significant reduction and solubilization of unwanted mineral encrustations on the fabrics to be softened. The compositions comprise mixtures of defined alkanolamine diesters and triesters in combination with at least one of certain organic acids such as citric acid.

10 Claims, No Drawings

FABRIC CONDITIONING COMPOSITION CONTAINING ALKANOL AMINE ESTER AND ACID

BACKGROUND OF THE INVENTION

This invention relates to fabric condition in compositions which are suitable for softening in the rinse cycle of an automatic household washing machine, and which are especially adapted for use under European laundering conditions. More particularly, the present invention relates to fabric conditioning compositions comprising defined alkanolamine diester and/or triester combination with an acid and optionally a fatty alcohol, which compositions are characterized by superior environmental compatibility relative to conventional tertiary amine or quaternary ammonium fabric softening compositions concomitant with providing improved calcium salt solubilization and reduction of encrustation on treated fabrics.

The combination of organic acid with cationic fabric softener such as amities and quaternary ammonium compounds is extensively disclosed in the prior art. U.S. Pat. Nos. 3,904,359 and 3,954,630 to Ramachandran disclose a fabric treating composition comprising a complexing acid such as citric or maleic acid in combination with a quaternary ammonium compound or amines such as primary tallow and primary coco amine. The function of the acid, as stated in the patents, is to prevent yellowing of fabrics due to build-up of cationic softener and to provide a complexing site for metal ions contained in soils. U.S. Pat. No. 4,828,722 to Steltenkamp and U.S. Pat. No. 4,869,836 to Harmalker disclose multicarboxylic acid complexes of tertiary amines formed from a tertiary amine and a carboxylic acid selected from among citric acid and di and tri carboxylic acids having 21 to 54 carbon atoms. In U.S. Pat. No. 4,832,856 is disclosed a fabric softener composition comprising a combination of carboxylic acid and amities having a long chain alkyl or alkenyl radical European Patent Publication No. 123,400 to Kardouch discloses detergent compositions containing salts of specified tertiary amities and carboxylic acids which are utilized in the form of modules that pass virtually unchanged through the wash and rinse and then condition the fabric when heated in a dryer. European Patent Publication No. 417,987 describes fabric softening compositions comprised of tertiary amities and carboxylic acids.

Although satisfactory results may be obtained with one or more of these prior art fabric softening compositions, further improvements are needed in terms of being able to provide efficacious fabric softening with a biodegradable cationic fabric softening compound, concomitant with the ability to substantially solubilize and remove mineral encrustation from the fabrics to be treated. This is a particularly important need for European fabric conditioning compositions where the cumulative deposition of mineral salts on fabrics during repetitive laundering in hard water is an acute problem. Moreover, the increased emphasis in Europe on using biodegradable softening compounds which have no toxic effect on aquatic organisms in aqueous effluent streams makes it imperative that conventional softening compounds, most notably, the di-long chain, di-short chain quaternary ammonium compounds be replaced as the softening compounds of choice in commercial rinse-cycle softening compositions with softening compounds which are significantly more compatible with environmental concerns.

SUMMARY OF THE INVENTION

The present invention provides environmentally compatible and biodegradable rinse cycle fabric conditioning compositions capable of providing improved softening with significant reduction and solubilization of unwanted mineral encrustations on fabrics to be softened, such encrustations having been generally deposited on the fabrics during the course of prior laundering in water having a high mineral content, which comprises a fabric conditioning mixture of:

(a) at least one of (i) an alkanolamine diester having the general formula:

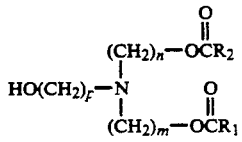

and;

(ii) an alkanolamine triester having the general formula:

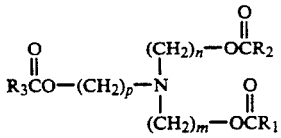

Wherein $R_1$, $R_2$ and $R_3$ are each independently hydrogenated tallow or soft tallow; and n, m and p are integers from 1 to 4; and (b) an organic acid or mineral acid.

In a preferred embodiment of the invention, the fabric softening composition further contains from about 0.2 to about 5%, by weight, preferably from about 0. 5 to about 3 %, and most preferably from about 0. 5 to 1 %, by weight, of a fatty alcohol having from about 10 to about 24 carbon atoms.

In preferred embodiments of the invention, the integers n, m and p in the general formula are 2, and $R_1$, $R_2$ and $R_3$ are hydrogenated tallow to provide a triethanolamine diester and/or triester.

The invention also encompasses a method for softening fabrics and removing unwanted mineral encrustations therefrom comprising rinsing the fabrics to be treated in an aqueous bath containing an effective amount of a composition comprised of the above-defined fabric conditioning mixture.

The present invention is predicated on the discovery that the combination of alkanol amine diester and/or triester fabric softener as defined above with an organic or mineral acid provides a biodegradable softener which has the capability of removing mineral encrustations such as calcium and magnesium salts, and in particular, phosphates and carbonates of calcium and magnesium, which cumulatively deposit on the fabrics during the course of prior laundering in hard water, ie. water having a mineral content above about 300 ppm, conditions generally associated with European laundering conditions.

A particularly preferred softening compound as described herein comprises a mixture of triethanolamine diester and triester sold by Hoechst Company under the trade designation of E 91/526 acid E 91/516.

DETAILED DESCRIPTION OF THE INVENTION

The compositions of the present invention are environmentally compatible and biodegradable rinse cycle fabric conditioning compositions which contain as the active fabric softening compound an alkanolamine diester and/or triester as defined above. The use of such fabric softening compound avoids the more traditional di-long chain, di-short chain quaternary ammonium softeners which are used extensively in commercial rinse cycle softeners, but which presently have become the focus of increasing legislative concerns, particularly in Europe, because of their lack of biodegradability in aqueous effluent streams.

The total amount of diester and triester amine in the total composition is from about 1 to 20%, by weight, preferably from about 2 to 10%, by weight.

The second essential ingredient of the fabric conditioning composition is the acid which has a dual function, depending on the acid concentration. The first function is preventive in nature and occurs when the acid in the diluted rinse cycle solution is present in sufficient amount to react with the insoluble salts of the water hardness ions (calcium and magnesium) to form soluble acid salts and to remove any mineral salts which may have deposited on fabrics during the washing step of the wash cycle. The second function is more curative in nature and refers to the removal of mineral encrustations which have been cumulatively deposited during prior washing throughout the fabric's life.

To effect the aforementioned preventive function, an acid concentration of from about 1 to about 8%, by weight, preferably from about 5 to about 8%, is required in the fabric softening composition depending on the dosage used and the hardness of the water. For European washing machines containing about 20 to 25 liters of water, for example, a dosage of 1 10 to 150 ml of softening composition is typical for use in the rinse cycle; the water hardness varies from about 200 to 400 ppm, most typically about 300 ppm. To effect the curative function of the acid for removal of previously deposited mineral encrustations, an acid concentration of from about 5 to about 25%, by weight, preferably from about 8 to 25%, by weight, is required in the fabric softening composition.

The acid used may be an organic or mineral acid. The organic acids are preferably saturated or unsaturated $C_2$–$C_6$ carboxylic acids such as citric acid, formic acid, maleic acid, tartaric acid and succinic acid. Citric acid, malonic acid and maleic acid are particularly preferred. A mineral acid, such as HCl, which is particularly effective to protonate the diester amine softening compound, may be advantageously combined with such organic acid. Generally, the concentration of mineral acid should not exceed about 5%, preferably not more than 2%, by weight, of the fabric conditioning composition so as to prevent unwanted product separation. A carboxylic acid may then be used to supplement the mineral acid up to a total acid content of about 25% without adversely affecting product stability.

An optional fabric conditioning ingredient is a fatty alcohol wherein the hydrophobic group may be a straight or branched chain alkyl or alkenyl group having from about 10 to 24, preferably from about 10 to 20, especially preferably from about 12 to 20 carbon atoms. Specific examples of the fatty alcohol include decanol, dodecanol, tetradecanol, pentadecanol, hexadecanol, octadecanol, lauryl alcohol, palmityl alcohol, stearyl alcohol, oleyl alcohol, and mixtures thereof. Furthermore, the fatty alcohol may be of natural or synthetic origin and my include, for example, mixed alcohol, such as $C_{16}$–$C_{18}$alcohols prepared by Ziegler polymerization of ethylene.

The fatty alcohol may be present in the composition in a minor amount relative to the cationic fabric softener such that the ratio, by weight, of the cationic fabric softener to fatty alcohol is in the range of from about 6:1 to 2: 1, preferably about 5:1 to 3: 1, and most preferably about 4: 1.

We claim:

1. An environmentally compatible and biodegradable fabric conditioning composition capable of providing improved softening with significant reduction and solubilization of unwanted mineral encrustations on fabrics to be softened, such encrustations having generally deposited on the fabrics during the course of laundering in water having a high mineral content, which comprises a fabric conditioning mixture of:

(a) from about 1 to 20% by weight of (i) an alkanolamine diester having the general formula:

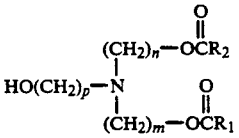

and (ii) an alkanolamine triester having the general formula:

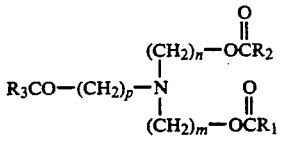

wherein $R_1$, $R_2$, $R_3$ are each independently hydrogenated tallow or soft tallow; and n, m, and p are integers from 1 to 4; and (b) from about 5 to 25% by weight an acid selected from the group consisting of citric acid, formic acid, maleic acid, malonic acid, tartaric acid and succinic acid.

2. A fabric conditioning composition according to claim 1 wherein in the general formula $R_1$, $R_2$ and $R_3$ are each hydrogenated tallow, and n, m and p are 2.

3. A fabric conditioning composition according to claim 1 wherein the acid is citric acid.

4. A fabric conditioning composition according to claim 1 wherein the acid is malonic or maleic acid.

5. A fabric conditioning composition according to claim 1 which further includes from about 0.2 to about 5%, by weight, of a fatty alcohol having from about 10 to about 24 carton atoms.

6. A fabric conditioning composition according to claim 5 wherein the fatty alcohol is a $C_{16}$–$C_{18}$ alcohol.

7. A method for softening and removing unwanted mineral encrustations therefrom comprising rinsing the fabrics to be treated in an aqueous bath containing an effective amount of a rinse cycle fabric conditioning composition comprising a fabric conditioning mixture of:

(a) from about 1 to 20% by weight of (i) an alkanolamine diester having the general formula:

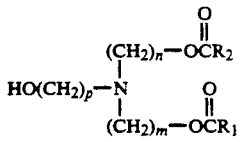

and (ii) an alkanolamine triester having the general formula:

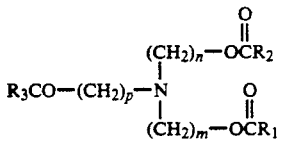

and, wherein $R_1$, $R_2$, $R_3$ are each independently hydrogenated tallow or soft tallow; and n, m, and p are integers from 1 to 4; and (b) from about 5 to 25% by weight an acid selected from the group consisting of citric acid, formic acid, maleic acid, malonic acid, tartaric acid and succinic acid.

8. The method of claim 7 wherein the acid is citric acid.

9. The method of claim 7 wherein the acid is malonic or maleic acid.

10. The method of claim 7 wherein the fabric conditioning composition further includes from about 0.2 to about 5%, by weight, of a $C_{16}$-$C_{18}$ alcohol.

* * * * *

UNITED STATES PATENT AND TRADEMARK OFFICE

CERTIFICATE OF CORRECTION

PATENT NO. : 5,288,847

DATED : February 22, 1994

INVENTOR(S) : Harmalker et al.

It is certified that error appears in the above-indentified patent and that said Letters Patent is hereby corrected as shown below:

Column 4, Line 41, that portion of the formula reading $R_3CO-$ should read $R_3\overset{\overset{\displaystyle O}{\|}}{C}O-$ Column 6, Line 5, that portion of the formula reading $R_3CO-$ should read $R_3\overset{\overset{\displaystyle O}{\|}}{C}O-$ Signed and Sealed this Twenty-seventh Day of December, 1994

*Attest:*

*Attesting Officer*

BRUCE LEHMAN

*Commissioner of Patents and Trademarks*